United States Patent [19]

Nichols

[11] 4,380,188

[45] Apr. 19, 1983

[54] HEAT-RETARDING AIR DISTRIBUTION UNIT

[75] Inventor: Richard K. Nichols, Huntsville, Ala.

[73] Assignee: Barber-Colman Company, Rockford, Ill.

[21] Appl. No.: 229,300

[22] Filed: Jan. 28, 1981

[51] Int. Cl.[3] ..... F24F 13/08

[52] U.S. Cl. ..... 98/40 D

[58] Field of Search ..... 98/40 R, 40 D, 40 DL, 98/DIG. 10; 138/159, 163

[56] References Cited

U.S. PATENT DOCUMENTS

| | | | |
|---|---|---|---|
| 3,522,724 | 8/1970 | Knab | 98/40 D |
| 3,785,272 | 1/1974 | McNabney et al. | 98/40 D |
| 4,146,048 | 3/1979 | McCabe | 137/75 |
| 4,261,501 | 4/1981 | Watkins et al. | 220/445 X |
| 4,280,536 | 7/1981 | Gnant | 138/159 X |

FOREIGN PATENT DOCUMENTS

| | | | |
|---|---|---|---|
| 2445443 | 4/1976 | Fed. Rep. of Germany | 98/40 D |
| 1206349 | 9/1970 | United Kingdom | 98/40 D |

OTHER PUBLICATIONS

Barber-Colman Company—condensed catalog "Air Distribution Products" AIA File No. 30-J.

*Primary Examiner*—Albert J. Makay
*Assistant Examiner*—Harold Joyce
*Attorney, Agent, or Firm*—Leydig, Voit, Osann, Mayer & Holt, Ltd.

[57] ABSTRACT

An air distribution unit for mounting in the ceiling of a room comprises a downwardly opening sheet metal box having a horizontal top wall and depending side walls. Conditioned air is introduced into the box through an inlet opening in the top wall and is diffused by a grille in the lower end of the box. A normally open damper automatically closes the inlet opening in the event of fire. The upper side of the top wall and the outer sides of the side walls are lined with panels of fire-resistant sheet rock which retards the transmission of heat through the box if a fire occurs.

13 Claims, 7 Drawing Figures

HEAT-RETARDING AIR DISTRIBUTION UNIT

BACKGROUND OF THE INVENTION

This invention relates generally to an air distribution unit adapted to be mounted in the ceiling of a room and adapted to diffuse air flowing into the room from an air duct located above the ceiling. More specifically, the invention relates to an air diffuser unit having a normally open fire damper which closes automatically in the case of fire in order to help retard the transmission of heat past the diffuser.

In office buildings or the like, a room typically is constructed with a suspended ceiling located below the structural members of the building. Located between the ceiling and the structural members is a plenum within which air distribution ducts may be mounted. It is desirable to provide a ceiling construction which, in the case of fire, is capable of retarding heat flow from the room through the suspended ceiling to the structural members above. The purpose of such a ceiling construction is to keep the air in the plenum below certain critical temperatures for as long as possible so as to reduce the danger of the structural members being weakened by heat to the point of permanent damage or collapse.

At present, suspended ceilings themselves can be constructed to meet certain fire standards or ratings, namely; those established by Underwriters Laboratories, Inc. In addition, automatically closable fire dampers associated with the duct work for delivering air into the room have been designed to meet U.L. fire ratings. The damper, however, is also associated with an air diffuser unit mounted in the suspended ceiling and, to the best of my knowledge, there has not heretofore existed a diffuser unit which could withstand designated fire tests and thus be fire-rated.

SUMMARY OF THE INVENTION

The general aim of the present invention is to provide a new and improved air diffuser unit which complies with designated fire standards and has been fire-rated and which, at the same time, is of relatively simple and inexpensive construction.

A more detailed object of the invention is to achieve the foregoing by providing an air diffuser unit whose plenum-exposed surfaces are all uniquely lined with a heat insulating material which is effective to retard the flow of heat upwardly through the diffuser to the plenum.

A further object is to provide an air diffuser unit in which the heat insulating material is in the form of comparatively inexpensive and relatively rigid panels adapted to be fastened securely to the unit in a quick and easy manner.

Still another object of the invention is to provide a unit having an air diffusing grille which remains securely attached to the unit under fire conditions and helps retard the transmission of heat through the unit.

The invention also resides in the relatively simple structural elements of the diffuser unit and in the construction which enables economical fabrication and assembly of the elements.

These and other objects and advantages of the invention will become more apparent from the following detailed description when taken in conjunction with the accompanying drawings.

DETAILED DESCRIPTION OF THE PREFERRED EMBODIMENT

Figure 1:
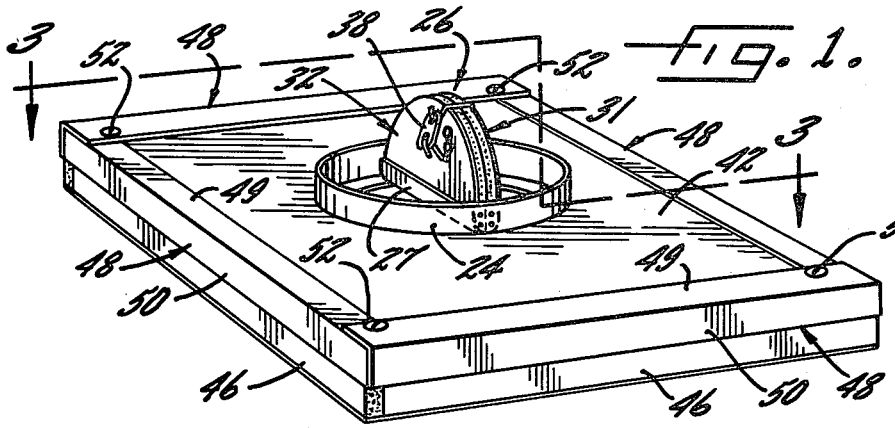
FIG. 1 is a top perspective view of a new and improved fire-rated air diffuser unit incorporating the unique features of the present invention.
Figure 2:
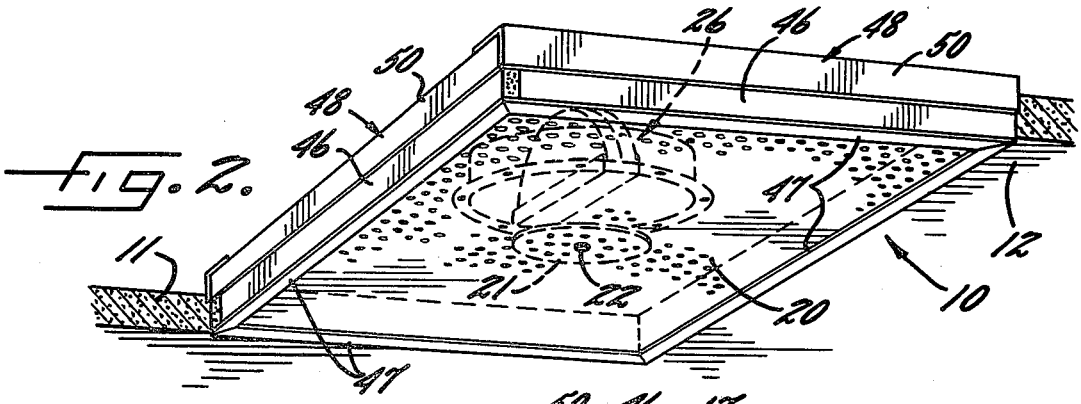
FIG. 2 is a bottom perspective view of the diffuser unit.

As shown in the drawings for purposes of illustration, the invention is embodied in an air distribution unit 10 adapted to be mounted in an opening 11 in the ceiling 12 of a room and adapted to diffuse conditioned air flowing into the room from a heating and/or cooling duct (not shown) located above the ceiling. In this instance, the ceiling is of the suspended type and is located below the structural members of the building. A cavity or plenum is located between the ceiling and the structural members and defines a space which accommodates the duct, electrical conduits and the like.

Figure 3:
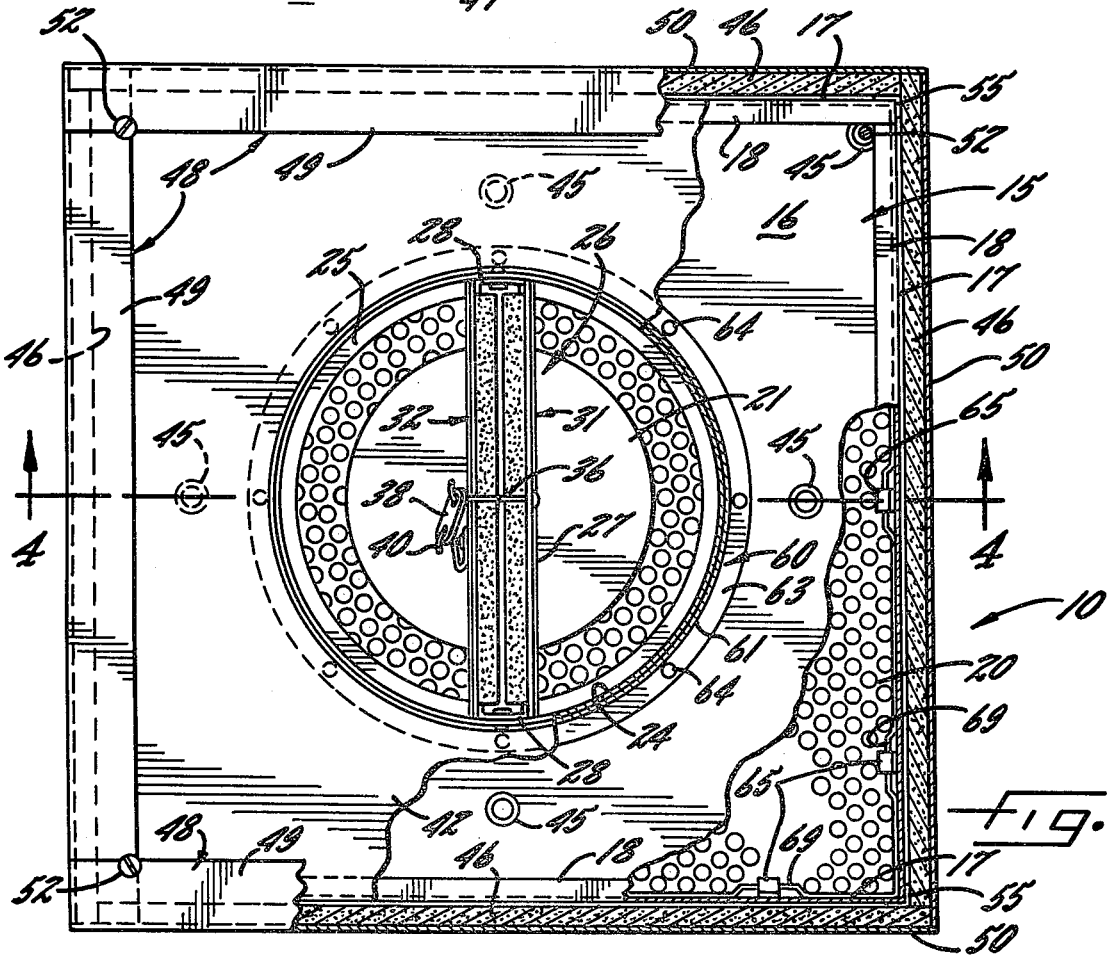
FIG. 3 is an enlarged top plan view of the unit as taken substantially along the line 3—3 of FIG. 1, certain parts of the unit being broken away and shown in section.
Figures 4, 5, 6:
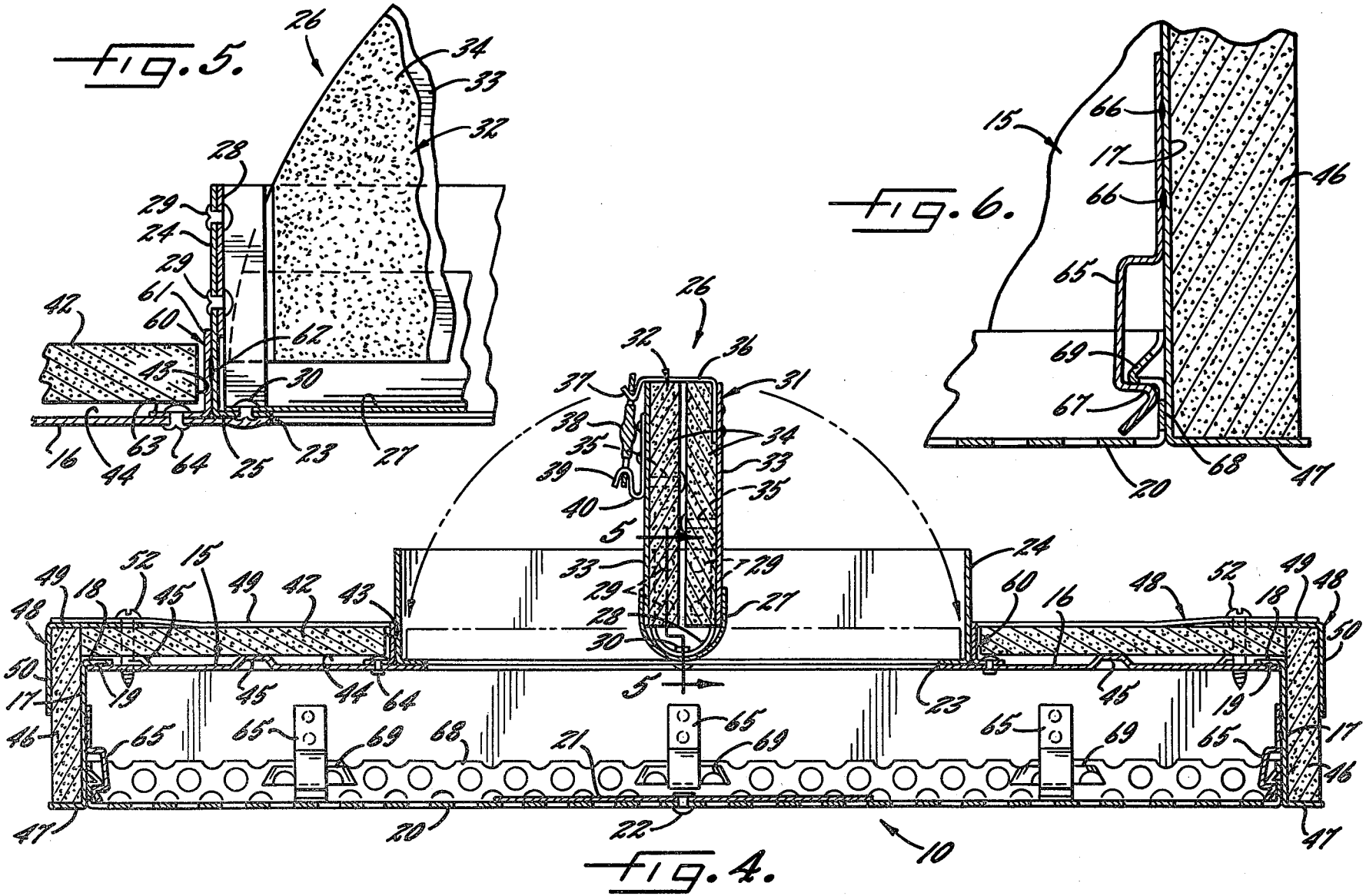
FIG. 4 is an enlarged cross-section taken substantially along the line 4—4 of FIG. 3.
FIG. 5 is an enlarged fragmentary cross-section taken substantially along the line 5—5 of FIG. 4.
FIG. 6 is an enlarged view of certain parts shown in FIG. 4.
Figure 7:
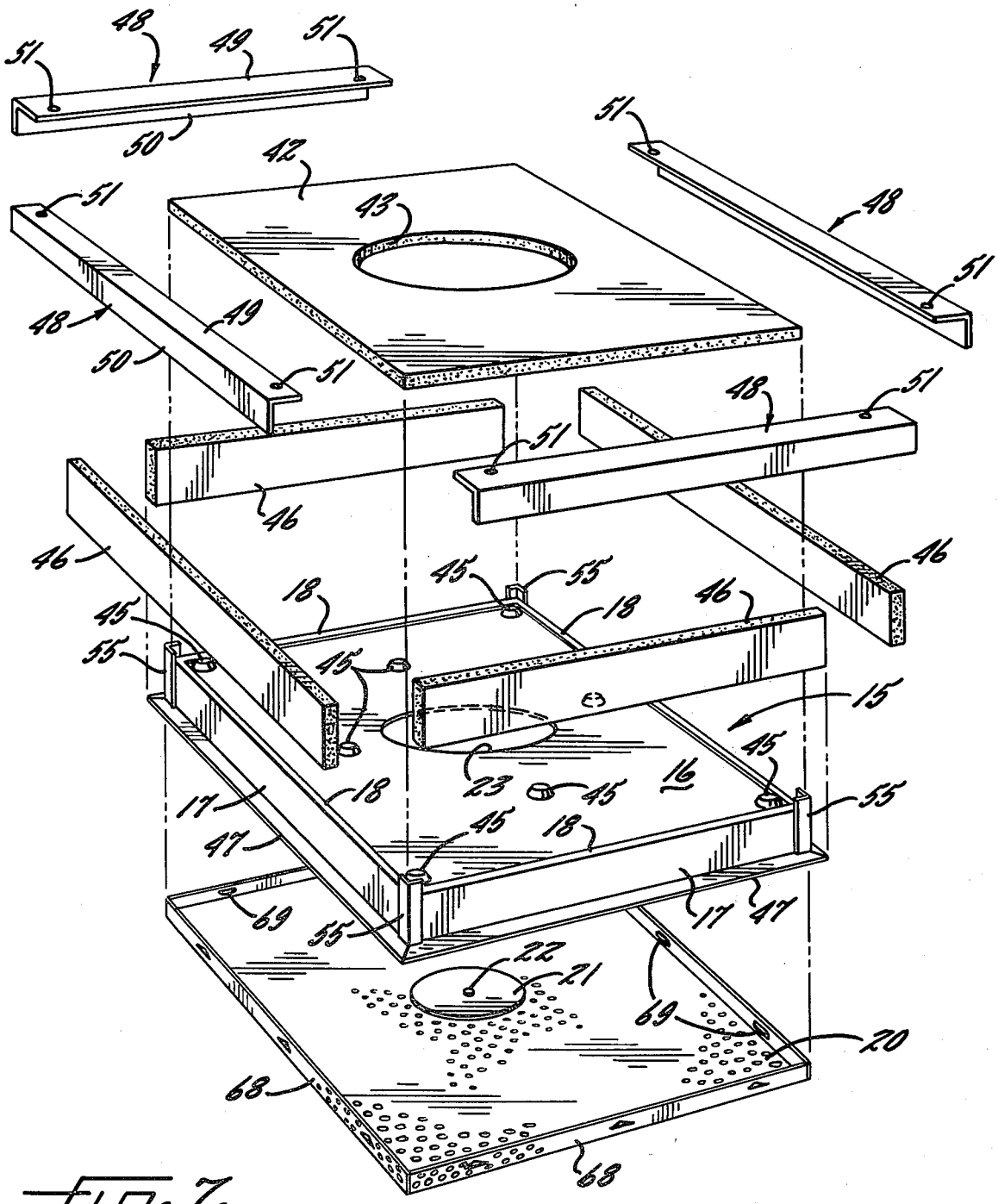
FIG. 7 is an exploded perspective view of certain parts of the diffuser unit.

Herein, the unit 10 is in the shape of a square, downwardly opening box 15 (FIGS. 3 and 7). The box is defined by a square and horizontally disposed top wall 16 made of sheet metal. Depending from the edges of the top wall are four sheet metal side walls 17 whose ends abut one another. An inwardly turned flange 18 (FIG. 4) is formed integrally with the upper end of each side wall and is welded at 19 to the upper side of the top wall 16. A grille 20 is secured to the box 15 adjacent the lower margins of the side walls 17 and serves to diffuse or distribute air flowing downwardly through the box from the duct. While the grille could be a louvered plate or the like, it herein is in the form of a perforated sheet metal screen. A circular metal disc 21 is located at the center portion of the grille on the upper side thereof and serves as a baffle to cause the air to flow horizontally and then downwardly through the perforations rather than flowing in a direct downward stream. The disc is riveted to the grille at 22.

A circular opening 23 (FIGS. 4 and 7) is formed through the center portion of the top plate 16 and is adapted to communicate with the duct in order to admit a downward flow of air into the box 15. To connect the box and the duct, an upstanding cylindrical pipe 24 is concentric with the opening 23 and its lower margin is formed with an inwardly turned flange 25 (FIGS. 4 and 5) which rests on the upper side of the top plate 16. A fire damper 26 is mounted in the pipe 24 and normally is open to allow air to flow from the duct into the box 15 through the pipe and the opening 23. If a fire occurs, however, the damper 26 automatically closes the opening 23 when the temperature adjacent the damper exceeds a predetermined value.

The constructional details per se of the damper 26 do not form part of the present invention. A suitable damper which may be used is generally similar to one of the dampers disclosed in McCabe U.S. Pat. No. 4,146,048. As shown in FIGS. 4 and 5, the damper 26 includes a U-shaped hinge 27 made of spring steel and extending diametrically across the lower end portion of the pipe 24. The end portions of the hinge straddle generally U-shaped brackets 28 (FIG. 5) which are riveted at 29 to the inner side of the pipe 24. The lower end of each bracket is secured to the flange 25 by a rivet 30 which also anchors the adjacent end of the hinge 27 to the bracket.

Disposed between and secured rigidly to the sides of the hinge 27 are two vanes 31 and 32 which normally are disposed vertically in open positions as shown in solid lines in FIG. 4 but which are adapted to swing in opposite directions to horizontally disposed closed positions shown in phantom lines. When in their closed positions, the vanes abut the upper side of the flange 25.

Each vane 31 and 32 comprises a semi-circular piece 33 (FIGS. 4 and 5) of sheet metal which is lined on its inner side by a piece 34 of heat insulating sheet rock, the metal and the sheet rock being secured together at 35. A wire 36 (FIG. 4) is fastened to the vane 31, extends across the free ends of the vanes and is hooked at 37 to one end of a fusible link 38. The other end of the link is hooked at 39 to one end of a wire 40 which is fastened to the vane 32. The wire 36, the link 38 and the wire 40 form a latch which normally holds the vanes together in their upright open positions shown in solid lines in FIG. 4. If a fire occurs, the link 38 melts when the temperature proximate to the link exceeds a predetermined value (e.g., about 165 degrees F.). When the link melts, the spring metal hinge 27 snaps the vanes downwardly to their closed positions to shut off the opening 23 and restrict the upward transmission of heat. The sheet rock pieces 34 face upwardly when the vanes are closed and serve to retard the upward radiation of heat from the metal pieces 33 of the vanes. A damper such as the damper 26 has been tested by Underwriter Laboratories, Inc. and has met the fire rating standards of that organization.

In accordance with the present invention, the diffuser 10 is constructed in such a manner that the entire diffuser retards the transmission of heat between the room and the plenum and indeed retards the heat so sufficiently that the diffuser has obtained fire-rated approval from U.L. Moreover, the elements which are used to make the diffuser fire-retardant are relatively inexpensive and may be assembled in a comparatively quick and easy manner.

To retard the transmission of heat through the diffuser 10, the top wall 16 and the side walls 17 of the box 15 are, in carrying out the invention, lined with heat insulating material. In this instance, the heat insulating material is relatively rigid and preferably is in the form of fire resistant gypsum sheet rock having a thickness of approximately ½ inch. Thus, a square-shaped top panel 42 (FIGS. 4 and 7) of sheet rock overlies the top wall 16 of the box 15 and is formed with a central opening 43 for accommodating the pipe 24. In keeping with the invention, the top panel 42 does not lie in direct contact with the top wall 16 but instead is spaced upwardly therefrom so that an air gap 44 (FIGS. 4 and 5) is formed between the top wall and the top panel in order to reduce the conduction of heat between the two. For this purpose, several (herein, eight) spaced protrusions 45 are struck upwardly from the top wall 16 and engage the underside of the top panel 42 to hold the latter upwardly away from the top wall. Four of the protrusions are located adjacent the corners of the top wall while the remaining four protrusions are spaced around the opening 23 and are located at three, six, nine and twelve o'clock positions (see FIGS. 3 and 7).

Pursuant to the invention, the outer side of each of the side walls 17 of the box 15 is lined with a rectangular panel 46 of sheet rock. As shown in FIGS. 4 and 6, each panel 46 is disposed in face-to-face relation with the outer side of a side wall 17 and is supported along its lower edge by a lip 47 which is formed integrally with and projects outwardly from the lower margin of the side wall. The upper edges of the side panels 46 are flush with the upper side of the top panel 42 while the inner sides of the upper end portions of the side panels abut the edges of the top panel (see FIG. 4).

Advantageously, all of the side panels 46 are of equal length so that any given panel can be assembled on any side wall 17 of the box 15. To enable the use of side panels 48 of equal length, the side panels are assembled such that one end of each panel abuts the end portion of one adjacent panel while the other end portion of each panel overlaps the end of the other adjacent panel as shown in FIG. 3.

To secure the panel 42 and the panels 46 to the box 15, there is provided a rectangular array of four inverted L-shaped bars 48 made of sheet metal. As shown in FIG. 4, each bar includes a horizontal flange 49 overlying the peripheral margin of the top panel 42 and further includes a vertical flange 50 lying alongside the outer side of the side panel 46. The end portions of the horizontal flanges 49 of two of the opposing and parallel bars 48 overlap the end portions of the horizontal flanges of the other two bars as shown in FIG. 1. Alined holes 51 (FIG. 7) are formed in the overlapping end portions of the bars adjacent the corners of the box 15 and are adapted to receive self-tapping screws 52 (FIGS. 3 and 5). The latter extend through the holes 51, extend through the top panel 42 and are threaded into holes formed in the four protrusions 45 at the corners of the box 15. When the screws are tightened, the horizontal flanges 49 of the bars 48 clamp the top panel 42 securely against protrusions 45 and, in addition, clamp the side panels 46 tightly against the lips 47. The vertical flanges 50 of the bars captivate the side panels 46 against the side walls 17. To further rigidify the unit 10, L-shaped retainers 55 (FIG. 7) are spot welded to the corners defined at the junctions of the side walls 17 and project upwardly therefrom. The corners of the top panel 42 abut the retainers 55.

By virtue of the heat insulating panels 42 and 46, the transmission of heat through the diffuser 10 is significantly retarded since all of the surfaces 16 and 17 which are exposed to the plenum are covered. As a result, the entire opening 11 in the ceiling 12 is closed by a fire-retarding unit and not just the opening 23 leading to the duct. The unit has obtained fire-rated approval from U.L. The fire rating of the diffuser is maintained even when a U.L. Class I flexible duct made of a material such as mylar and having a length of up to 13 feet is connected to the pipe 24. In installations which have only a fire-rated damper, the overall installation achieves U.L. fire rating only when a rigid vertical steel riser duct is connected to the damper to serve as a heat sink in the plenum. The flexible duct which may be used with the present diffuser is easier to install and enables greater design freedom in establishing or changing the location of the diffuser in the ceiling.

By virtue of its construction, the diffuser 10 can be mounted with its underside flush with the ceiling 12 and still maintain the U.L. fire rating of the overall installation. Prior diffusers utilizing only a U.L. approved fire damper must be mounted with the damper itself flush with the ceiling in order to achieve approved fire rating of the complete ceiling installation. When a diffuser is used with a flush-mounted damper, the diffuser projects downwardly below the ceiling and creates an undesirable appearance. Such undesirable appearance is avoided with the present diffuser and yet the fire rating of the ceiling installation is maintained.

It is important that the unit 10 be mechanically rigid and capable of withstanding relatively high temperatures without falling apart. In one respect, this is achieved by securing the pipe 24 and the damper 26 rigidly to the box 15. For this purpose, a ring 60 (FIG. 5) of L-shaped cross-section is formed with a vertical leg 61 which is welded at 62 to the outer side of the pipe 24 adjacent the lower end thereof. At its lower end, the ring is formed with a horizontally extending leg 63 which is riveted at 64 to the upper side of the top wall 16 of the box 15. As a result, the pipe 24 is supported rigidly around its circumference, is attached rigidly to the top wall 16 and, at the same time, the center portion of the top wall is stiffened.

Further, means are provided for preventing the grille 20 from dropping out of the box 15 when the unit 10 is subjected to fire. Herein, these means comprise several (e.g., twelve) clips 65 (FIG. 6) made of spring metal or other resiliently yieldable material and welded at 66 to the inner sides of the side walls 17, there being three clips spaced along each side wall. The lower end portion of each clip is formed with a bent V-shaped hook 67. Integral with and upstanding from the periphery of the grille 20 is a flange 68 which is formed with a series of inwardly projecting and reversely bent V-shaped hooks 69 (FIG. 6). When the grille 20 is telescoped upwardly into the lower end of the box 15, the hooks 69 first cam against and then snap past the hooks 67. In the finally assembled position of the grille, the hooks 69 interlock with the hooks 67 with a tight but releasable snap fit. Thus, the grille may be removed from the box for purposes of cleaning the grille and the inside of the box but yet, at the same time, the grille is secured tightly within the box. In the event of a fire, such tight securement holds the grille in the box so that the grille and the diffuser disc 21 thereon may radiate heat away from the plenum.

I claim:

1. A heat-retarding air distribution unit comprising a downwardly opening box made of sheet metal, said box having a generally rectangular and horizontal top wall and having side walls depending from said top wall, an air inlet opening in said top wall, a damper disposed adjacent said opening and normally located in an open position, means for causing said damper to close said opening automatically when the temperature therein exceeds a predetermined value, a grille secured to the lower end of said box adjacent the lower margins of said side walls and operable to diffuse air flowing downwardly through said box from said inlet opening, a relatively rigid top panel of heat insulating material lining the upper side of said top wall, relatively rigid side panels of heat insulating material lining the outer sides of said side walls, an outwardly projecting lip formed intergrally with the lower margin of each of said side walls, the lower edges of said side panels resting on said lips, and means for securing said panels to said walls, said securing means comprising a rectangular array of inverted L-shaped bars, said bars having horizontal flanges overlying said top panel and having vertical flanges lying alongside the outer sides of said side panels, and screws extending through the horizontal flanges of said bars, through said top panel and threaded into the top wall of said box.

2. A heat-retarding air distribution unit as defined in claim 1 in which said panels are made of sheet rock.

3. A heat-retarding air distribution unit as defined in either of claims 1 or 2 in which said side panels are all of the same length, one end portion of each side panel overlapping the end of one adjacent side panel, and the other end of each side panel abutting the end portion of the other adjacent side panel.

4. A heat-retarding air distribution unit as defined in claim 1 in which the end portions of the horizontal flanges of two opposing bars overlap the end portions of the horizontal flanges of the other two opposing bars, said screws being located at the corners of said array and extending through the overlapped end portions of the horizontal flanges.

5. A heat-retarding air distribution unit as defined in either of claims 1 or 2 further including protrusions projecting upwardly from the top wall of said box and engaging the underside of said top panel to establish an air gap between said top panel and said top wall.

6. A heat-retarding air distribution unit comprising a downwardly opening box made of sheet metal, said box having a generally square and horizontal top wall and having side walls depending from said top wall, an air inlet opening in said top wall, a pipe secured to and projecting upwardly from said top wall and alined with said opening, a damper disposed in said pipe and normally located in an open position, means for causing said damper to close said pipe automatically when the temperature adjacent the damper exceeds a predetermined value, a grille secured to the lower end of said box adjacent the lower margins of said side walls and operable to diffuse air flowing downwardly through said box from said inlet opening, a top panel of sheet rock lining the upper side of said top wall and having a hole therein accommodating said pipe, side panels of sheet rock lining the outer sides of said side walls, said side panels all being of the same length, one end portion of each side panel overlapping the end of one adjacent side panel, the other end of each side panel abutting the end portion of the other adjacent side panel, outwardly projecting lips formed integrally with and projecting outwardly from the lower margins of said side walls and supporting the lower edges of said side panels, a square array of inverted L-shaped bars, said bars having horizontal flanges overlying said top panel and the upper edges of said side panels and having vertical flanges lying alongside the outer sides of said side panels, and screws extending through the horizontal flanges of said bars, through said top panel and threaded into the top wall of said box.

7. A heat-retarding air distribution unit as defined in claim 6 further including protrusions projecting upwardly from the top wall of said box and engaging the underside of said top panel to establish an air gap between said top panel and said top wall.

8. A heat-retarding air distribution unit as defined in claim 7 in which the end portions of the horizontal flanges of two opposing bars overlap the end portions of the horizontal flanges of the other two opposing bars, said screws being located at the corners of said array and extending through the overlapped end portions of the horizontal flanges.

9. A heat-retarding air distribution unit as defined in claim 7 in which said screws are threaded into said protrusions.

10. A heat-retarding air distribution unit as defined in claim 7 in which said protrusions are integral with and are struck upwardly from said top wall.

11. A heat-retarding air distribution unit as defined in claim 6 further including L-shaped retainers secured to the corners of said side walls and projecting upwardly therefrom, the corners of said top panel abutting said retainers.

12. A heat-retarding air distribution unit as defined in claim 6 further including resiliently yieldable clips secured to the inner sides of said side walls and spaced along said side walls, an upstanding flange extending around the periphery of said grille, and inwardly projecting means spaced along the inner side of said upstanding flange and interlocking with said clips with a releasable snap fit to secure said grille to the lower end of said box.

13. A heat-retarding air distribution unit as defined in claim 6 further including a ring of L-shaped cross-section, said ring having a vertically extending leg secured to the outer side of said pipe and having a substantially horizontally extending leg secured to the upper side of said top wall.

* * * * *